US005293698A

United States Patent [19]

Petersen

[11] Patent Number: 5,293,698

[45] Date of Patent: Mar. 15, 1994

[54] SYSTEM FOR TEMPORARILY STORING PRINTED PRODUCTS REMOVED FROM A PRINTING MACHINE

[75] Inventor: Godber Petersen, Augsburg, Fed. Rep. of Germany

[73] Assignee: MAN Roland Druckmaschinen AG, Offenbach am Main, Fed. Rep. of Germany

[21] Appl. No.: 852,683

[22] Filed: Mar. 17, 1992

[30] Foreign Application Priority Data

Apr. 30, 1991 [DE] Fed. Rep. of Germany ..... 4114096

[51] Int. Cl.[5] ..... B65H 39/02

[52] U.S. Cl. ..... 34/149; 34/150; 270/54; 270/58

[58] Field of Search ..... 34/189, 194, 202, 192, 34/150, 149, 109; 270/54, 58, 11-15, 38, 47, 48, 54, 45, 55; 198/424

[56] References Cited

U.S. PATENT DOCUMENTS 4,807,865 2/1989 Kobler et al. .
4,840,365 6/1989 Kobler et al. .
4,871,159 10/1989 Petersen .

FOREIGN PATENT DOCUMENTS 3304673 8/1984 Fed. Rep. of Germany .
3621832 9/1987 Fed. Rep. of Germany .
3621822 1/1988 Fed. Rep. of Germany .

OTHER PUBLICATIONS

Clarkson, Bierworth, "Sheet Sorter", Apr. 1976, Xerox Disclosure Journal, Stamford, U.S.A., vol. 1, No. 4.

*Primary Examiner*—Henry A. Bennet
*Attorney, Agent, or Firm*—Frishauf, Holtz, Goodman & Woodward

[57] ABSTRACT

To provide for temporary storage of freshly printed signatures (6), transported by a continuously moving product transport gripper chain (4, 5), a plurality of pocket structures (12), each of which includes a plurality of connected sheet-like elements (16,17) which, between each other, define pockets (15), are provided. The sheet-like elements are arranged for pivotable movement about an end portion to permit fan-like spreading out of the elements for reception in the pockets of, for example, one product or signature delivered by the transport system. Storage units are provided to store empty pocket structures and to receive pocket structures which are filled with signatures. The storage structures, preferably, are formed of separate sheet-like elements connected together, and engaging the signatures at marginal portions, so that access can be provided to the signature, for example from below, for compressed air or other drying gas, to dry the fresh ink on the signatures, for example when placed within the storage units (26). To space the sheet-like elements, preferably, a small projection or tab is placed on them at facing surfaces, in the region of the margins of the signatures, that is, in non-printed areas thereof.

20 Claims, 7 Drawing Sheets

SYSTEM FOR TEMPORARILY STORING PRINTED PRODUCTS REMOVED FROM A PRINTING MACHINE

Reference to related patents assigned to the assignee of the present application.

U.S. Pat. No. 4,840,365, Kobler and Petersen

U.S. Pat. No. 4,871,159, Petersen.

Reference to related application, assigned to the assignee of the present application U.S. Pat. No. 07/329,798, filed Mar. 28, 1989, Petersen, now U.S. Pat. No. 5,129,781, Jul. 14, 1992.

Reference to related publication

German Patent 33 04 673, Baucke.

FIELD OF THE INVENTION

The present invention relates to paper handling in combination with a printing machine, and more particularly to remove, temporarily store, and hold for further transport of printed sheets, and more particularly of freshly printed sheets which should be handled as separate items so that freshly printed ink does not cause adhesion of sheets placed against each other.

BACKGROUND

It is known to remove freshly printed sheets from a printing machine by gripping the sheets with grippers attached to a transport chain, and deliver the freshly printed sheets to a sheet distributing apparatus or system. Numerous such apparatus or systems are known, in which the sheets, removed by the grippers on a transport chain, are then stacked on receiving platforms, pallets, or other reception structures.

Continuous supply of sheets from the printing machine requires intermittent removal of the stacks of printed sheets. When the printing machines operate at high speed, it is difficult to align the stacks, and it has been proposed to provide additional auxiliary stacking platforms—see, for example, the referenced German Patent 33 04 673, Baucke. Auxiliary stacking platforms require a substantial amount of space. Further, as the stack increases in height, and becomes heavier and heavier, the freshly printed sheets may adhere against each other. It has been proposed to insert small intermediate plates from time to time as the stack increases. These intermediate plates are supported with respect to each other. This arrangement, however, substantially decreases the overall operating speed of the printing machine—stacking combination. The stacking system of this type is much slower than the speed of the printing machine.

It has further been proposed to dry the printed sheets by introducing a drying air jet which is so arranged that drying air is blown between adjacent sheets as the sheets are turned over, and pass through an essentially vertical position. It has been found that this does not result in satisfactory drying; loosening of the sheets forming the stack with respect to each other is effective only to a limited extent, or the overall stack will become unstable and difficult to handle.

THE INVENTION

It is an object to provide a system and apparatus to receive freshly printed sheets from a printing machine which permits temporarily storing the sheets and drying the sheets, which does not require much space, and in which adhesion of freshly printed sheets against each other is effectively eliminated, and which permits, further, to supply the sheet to apparatus for further processing them, for example for finish drying them, without stacking the sheets above each other.

Briefly, a plurality of pocket structures are provided; each one of the pocket structures has a plurality of sheet-like pocket forming elements. Two adjacent ones of these pocket forming elements define a pocket therebetween. The pocket forming elements are secured together at one end portion, for example at an end edge, to permit the pockets to fan out or spread apart for reception of for example one freshly printed sheet or other printed product therein. The pockets can be collapsed against each other, selectively, with or without products therein. Thus, a plurality of such pocket structures can be stored in a storage unit and transported or placed in position to receive products from a gripper chain conveyor. When the pockets are filled, the pocket structure can be removed, and collapsed, and then take up little space, while a new, empty pocket structure is placed in position, and fanned out to receive additional sheets.

DRAWINGS illustrating the apparatus in simplified or schematic form, and illustrating only those portions necessary for an understanding of the invention, and omitting all auxiliary components or engineering structures.

DETAILED DESCRIPTION

Figure 1:
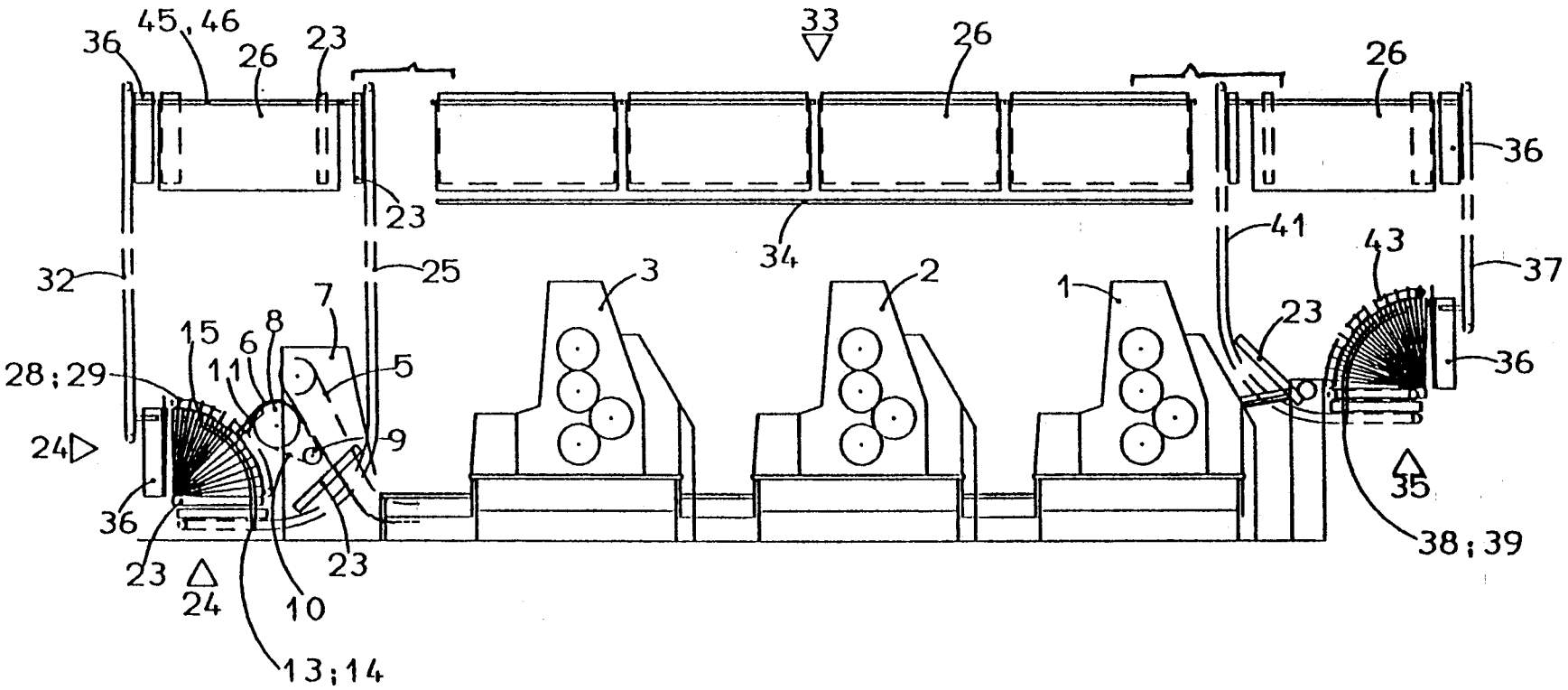
FIG. 1 illustrates an overall printing system having three printing stations, and the removal and temporary storage system of the present invention.

Referring first to FIG. 1, which illustrates an embodiment of the present invention in combination with a printing machine, for example a sheet-fed printing machine, or a printing machine which provides cut sheets at the output. thereof. The printing machine has printing systems or printing units 1, 2, 3. The printed signatures 6 are removed from the printing machine system 1, 2, 3 by an endless-chain 5 (FIG. 2) on which grippers 4 are secured. The endless chain 5 transports the sheets to a delivery station 7. Rollers 8, 9 guide suction webs 10, which are operatively coupled to a slide surface 11. The slide surface 11 includes a cam roller 30, rotating in synchronism with the operation of the printing machine and the chain 5. The suction webs or belts 10 form a transport system for the signatures 6 to the removal and storage system in accordance with the present invention.

Figure 3:
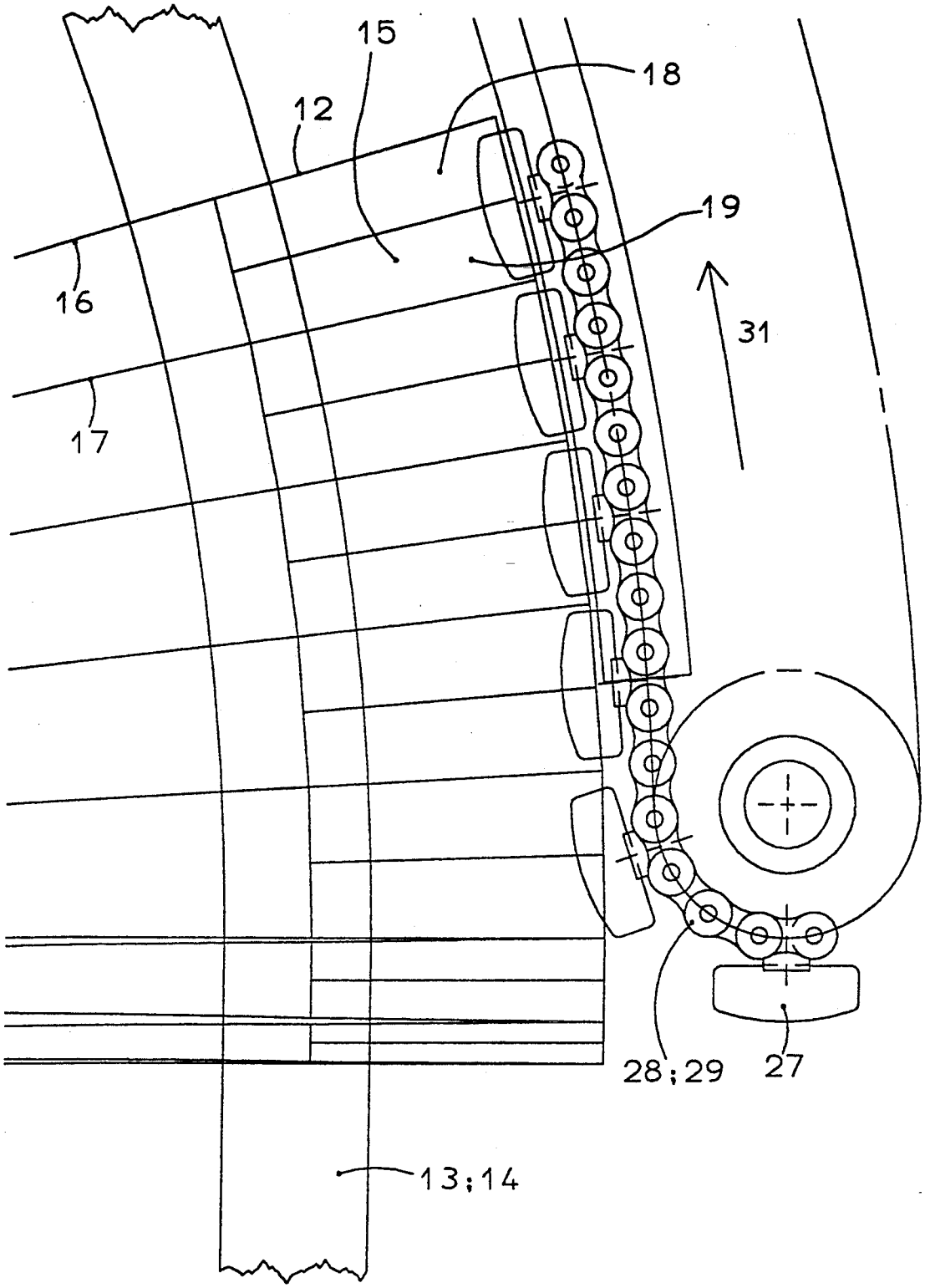
FIG. 3 is an enlarged fragmentary side view of the pocket structure.
Figure 4:
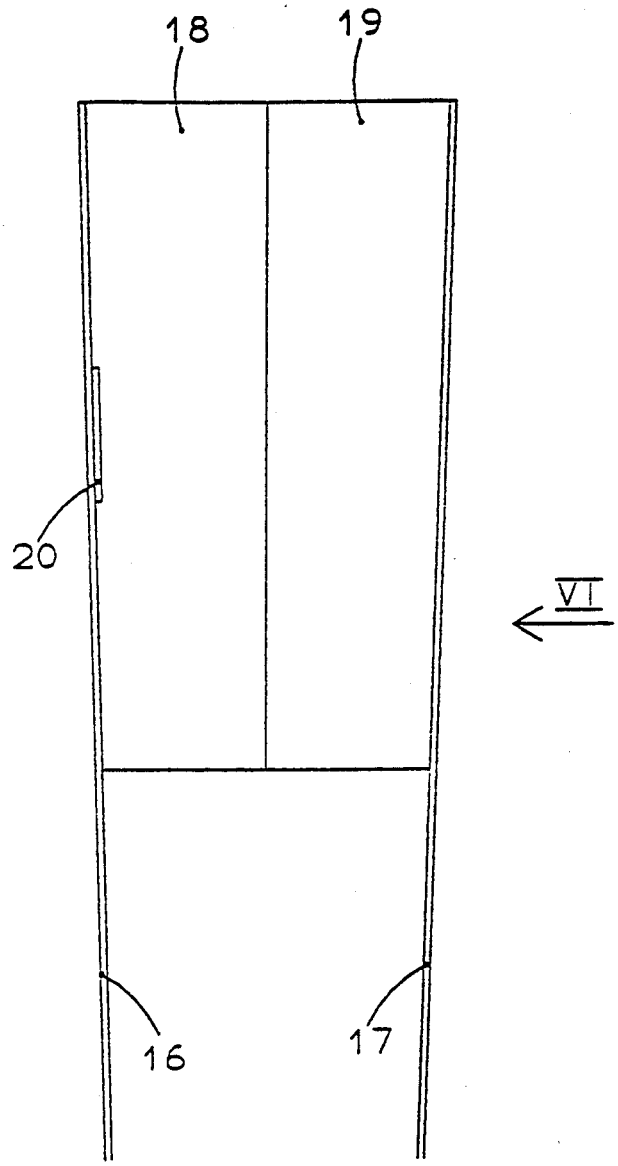
FIG. 4 is a fragmentary front view of a pocket structure.

In accordance with a feature of the present invention, the removal and temporary storage system is a pocket structure 12. Numerous structural arrangements are possible to form pockets, and one such arrangement is well known, and described, for example, in the referenced U.S. Pat. No. 4,840,365, Kobler and Petersen, assigned to the assignee of the present invention in greater detail. In accordance with a preferred feature of the invention, the pocket structure 12, as used in the present example, has pocket segments 15 (see FIG. 3) guided laterally on rails 13, 14. The pocket segments 15 are formed by the spare between segmental pocket elements 16, 17, which may be elastic flat or strip structures, for example of sheet metal. These sheet-metal elements 16, 17 are coupled together by V-shaped connecting elements 18, 19. They may be connected, for example, by welding. If the sheet-metal elements are made of other materials, suitable connections can readily be used. Of course, and as clearly apparent from FIGS. 2 and 3, the segments 15 can be placed against each other in any quantity in order to form the pocket structure 12 of sufficient length. The segments 15 then can be pulled out, or compressed, in fan-shaped arrangement, that is, the pocket structure can be spread or collapsed, as desired. To space the structure elements, for example the sheet-metal elements 16, 17 of the segments 15, when they are closed, each one of the sheets 16 has a small tab 20 (see FIGS. 4, 5) secured thereto. FIG. 4 illustrates a segment 15 in expanded or spread condition, and FIG. 5 in collapsed or flat, folded condition, with a signature 6 between the sheet elements 16, 17.

Figure 6:
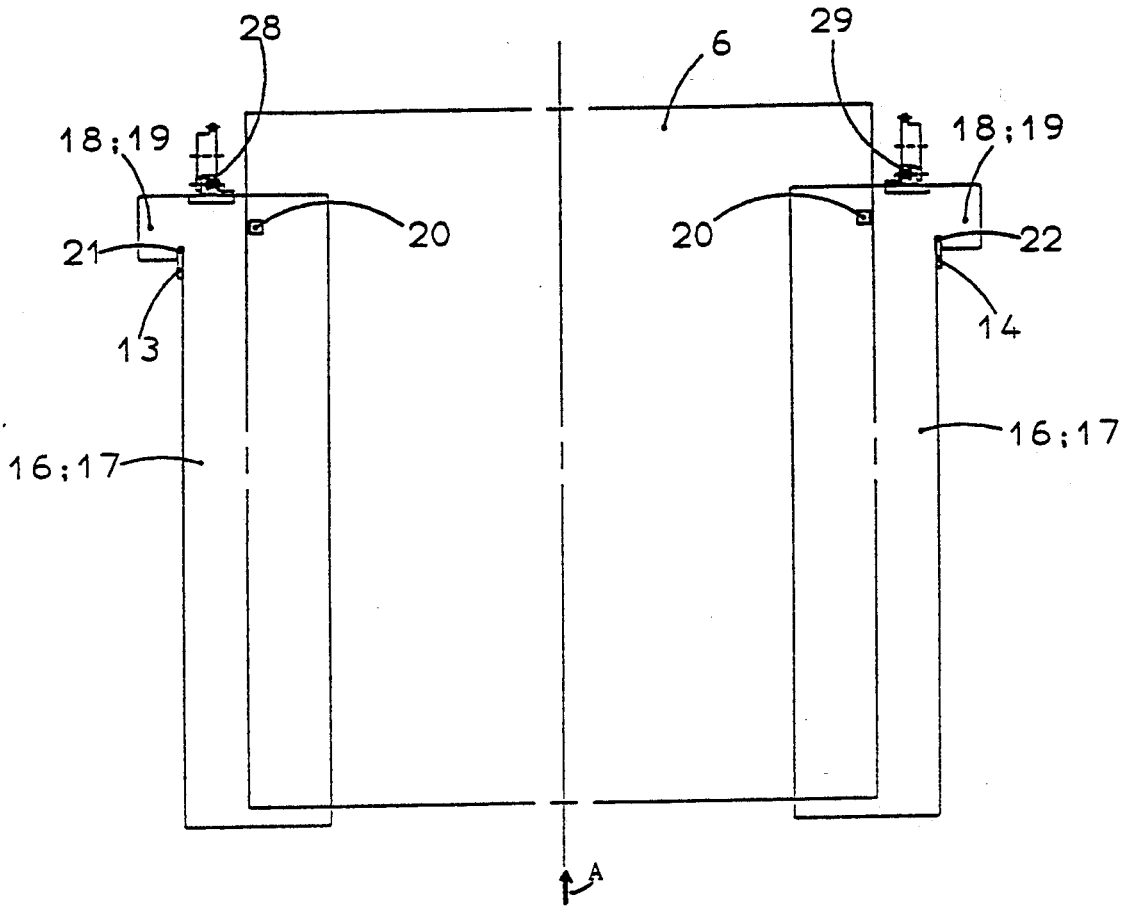
FIG. 6 is a view of the pocket structure of FIG. 5 taken in the direction of the arrow VI in FIG. 4.
Figure 7:
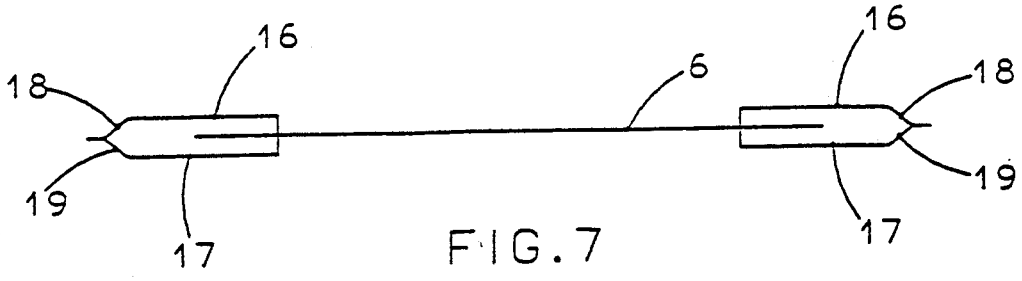
FIG. 7 is a top view of the pocket structure taken in the direction of the arrow VII of FIG. 5.

The pocket structure 12, see FIGS. 6 and 7, is formed of two portions, in which the segments 15 are so placed that pairs thereof work together, to receive signature 6 at the respective sides thereof. The pairs are retained, respectively, on rails 13, 14, over which the respective elements of the pairs are hooked by recesses 21, 22, so that the sheets 16, 17 of each pair are retained on the rails 13 and 14, respectively, and guided thereon. A uniform number of such segments 15 is combined to form a single pocket package 23 (see FIG. 2). The pocket packages are preferably held at the bottom, that is, at an apex of the essentially quarter-circular package, when spread apart, for example by a suitable ring or the like passed through an opening at the bottom of the respective sheets 16, 17 (not shown for simplicity of the drawing).

Figure 2:
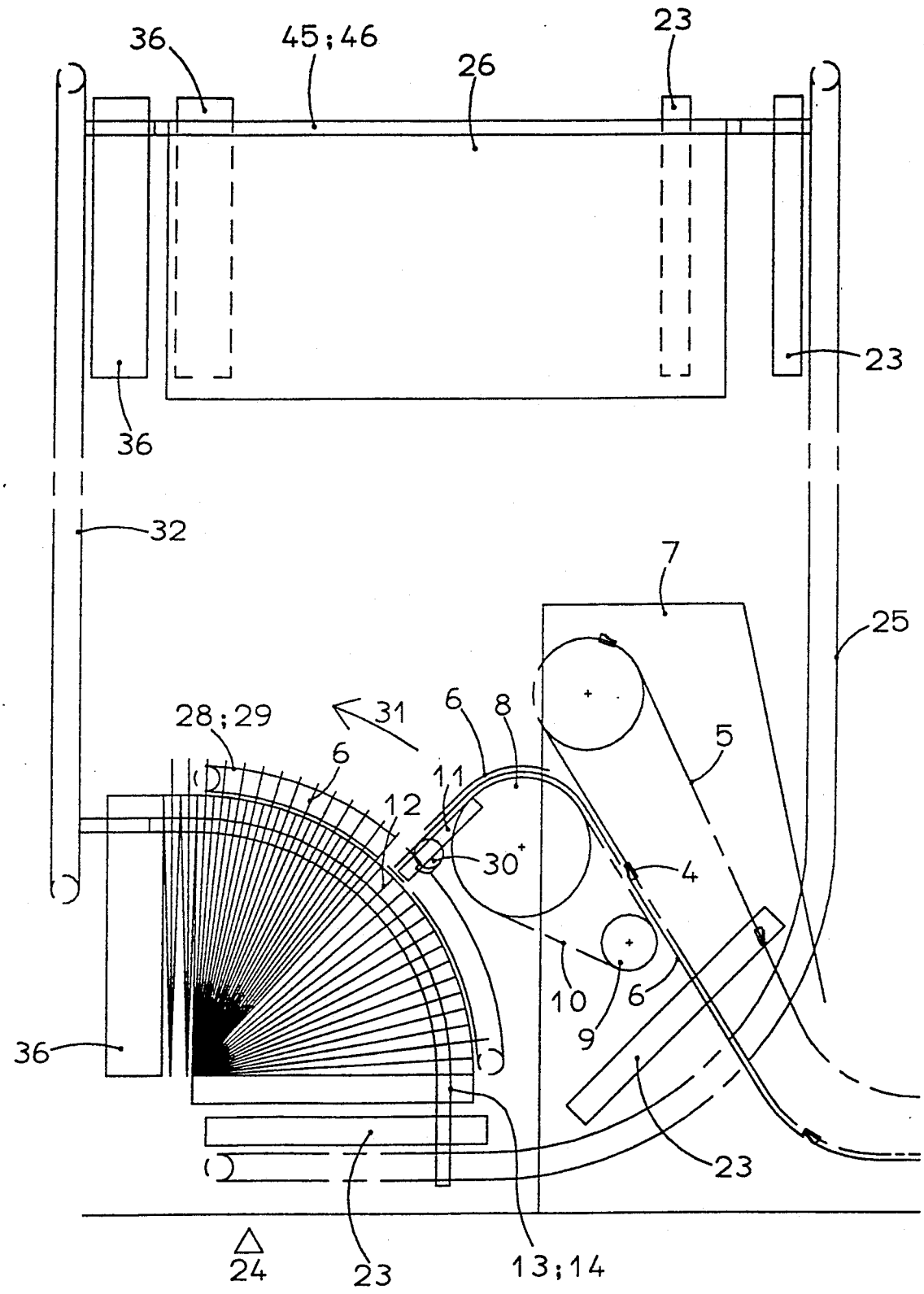
FIG. 2 is a detail view of the pocket structure.

FIG. 2 illustrates the loading region 24 in which the pocket structure 12 is fanned or spread out. The loading region 24 is coupled to a storage unit which, preferably, includes a storage cassette or holding box 26. Such a cassette or holding box is well known antidescribed for example, in the referenced application by the inventor hereof. U.S. Ser. No. 07/329,798, filed Mar. 28, 1989, now U.S. Pat. No. 5,129,781. Such cassettes and storage systems are also shown in U.S. Pat. No. 4,871,159, by the inventor hereof, and assigned to the assignee of the present application. Empty pocket packages 23 can thus be stored in such a storage unit or cassette or box; if the packages are not to be coupled together, they can be clipped, for example, or clamped at the loading station 24 so as to fan out into the fan-like position shown in FIG. 2, when guided on the rails 13, 14. Drive chains 28, 29 (FIGS. 3 and 6) are positioned parallel to the rails 13, 14 which guide the segments 15. The chains 28, 29 have follower dogs 27 located thereon. The chains are endless and dip into the pockets 15, as seen in FIG. 3, laterally of the signature 6, as seen in FIG. 6.

Operation

The sheets, that is the printed products or signatures 6, are continuously supplied at the removal station 7. They are transported by the suction webs 10 on the slide surface 11. A pocket package 23, previously removed from the storage box 26 and transported to the storage or loading region 24 is coupled by the transport chain 25 (FIG. 2) to the prior, already partially spread-apart package 23 in the region 24, so that the follower dogs 27 of the drive chains 28, 29 will engage into the segments 15 of the new pocket structure 12. They pull out the pockets in the direction of the arrow 31 (FIG. 2), thereby opening the segments in fan-like condition. The sheets,, arriving on the slide surface 11, are thus distributed in clocked timing, individually, into the segments 15. They are spaced from each other by the sheet elements 16, 17. Thus, the freshly printed signatures are separated from each other. The cam roller 30 assists in the insertion process, by lifting the end of an already partially inserted signature as soon as a subsequent signature is ready for insertion.

The arrangement has the advantage that it is readily possible to remove, for example manually, a signature from the fan-like spread pocket structure, for example for checking or the like.

As soon as a package 23 of pocket structures is filled with printed signatures 6, it can be collapsed to form a complete or full package 36 (FIG. 2). At that point, chains 32 engage the package 36, which will be uncoupled from the chain drive by chains 28, 29, for raising and delivery of the filled package 36 to the storage box or cassette 26.

The storage box 26 likewise has rails 45, 46, similar to the rails 13, 14. The cassette, thus, can supply from the one side empty pocket structures 23—see the right portion of FIG. 2—and receive pocket structures 36, filled with signatures at the left side. The manner of coupling and uncoupling is known, see for example the referenced Peterson application Ser. No. 07/329,798, now U.S. Pat. No. 5,129,781 referred to above, and U.S. Pat. No. 4,871,159, as well as the referenced Kobler U.S. Ser. No. 4,840,365. The segments 15 of the pocket structure 12, that is, the empty structure 53 or the filled structure 36, is thus always guided on the rails 13, 14 or 45, 46.

The system operates continuously, so that no back-up of the continuously supplied signature 6 will result. A new package 23 of pockets is fanned out at the same time while a loaded package 36 of the pocket structure 12 is collapsed or compressed for placement into the holding box or cassette 26. The system has the additional advantage that no forces are applied in a surface perpendicular to the plane of the signatures 6.

Figure 5:
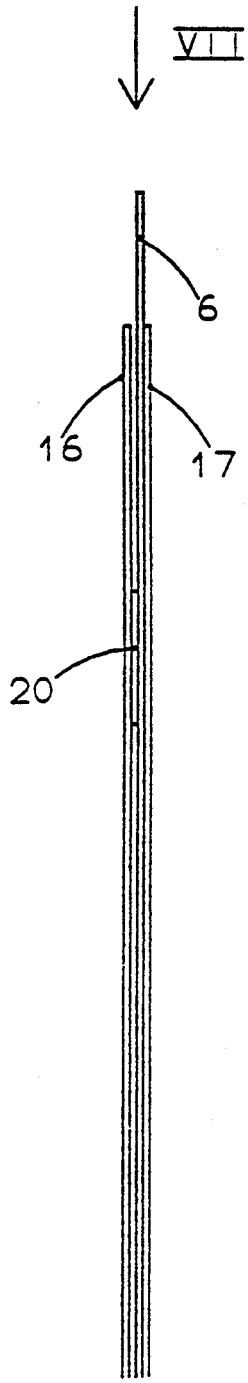
FIG. 5 is an end view of the pocket structure, when collapsed.

FIG. 5 is a side view of a closed segment 15 with a signature 6 between the sheet elements 16, 17. The tab 20 at the inside of the sheet 16 decreases the engagement or touching surface between a sheet 16 and the printed side of the signature 6, since it is located at the inside of the sheet 16. It is at the edge thereof, so it engages only the margin of the signature 6, and not printed subject matter thereon.

The cassette 26, when filled with loaded packages 36, in which the packages 36 are retained on the rails 45, 46 can be transported to further transport or storage stations, as shown in FIG. 1, by well known further transport systems, not shown for simplicity of the drawings. As best seen in FIG. 1, it is easily possible to arrange a buffer storage system 33, in which a plurality of cassettes 26 are collected. At that buffer storage section, a compressed air line 34, located between the buffer storage 33, can readily supply compressed air to the signatures which are fitted into the pockets 15 of the fill packages 36. These pockets, as clearly seen in FIG. 6, are open at the bottom, so that access by compressed air in the direction of the arrow A of FIG. 6 is readily possible. This ensures satisfactory drying.

The system can readily be operated in reverse direction, as also shown in FIG. 1. Independently of buffer storage, or subsequent to buffer storage and drying, the signatures 6 can be removed from a loaded storage cassette 26. The loaded pockets, by reversing the loading process of the packages 23 in the loading region 24, are removed at an unloading station 35 (FIG. 1). This unloading station may, for example, be coupled to the printing machines 1, 2, 3, for example for printing on a verso side of the signatures. For unloading, the loaded packages 36 are transferred by a chain system 37 to the rails 38, 39 of the unloading or removal station 35. At the unloading or removal station 35, the compressed or collapsed packages 36 are fanned out by a drive chain 43, operating similarly to the chains 28, 29 but in reverse direction. The signatures 6 now can be removed, in well known manner, for example by gripper chains or the like, and transported individually, for example for subsequent printing. The empty packages 23 are then transferred by transfer chain 41 back into the storage cassette 26.

All processing of signatures, thus, is obtained without stacking the signatures above each other.

Figure 8:
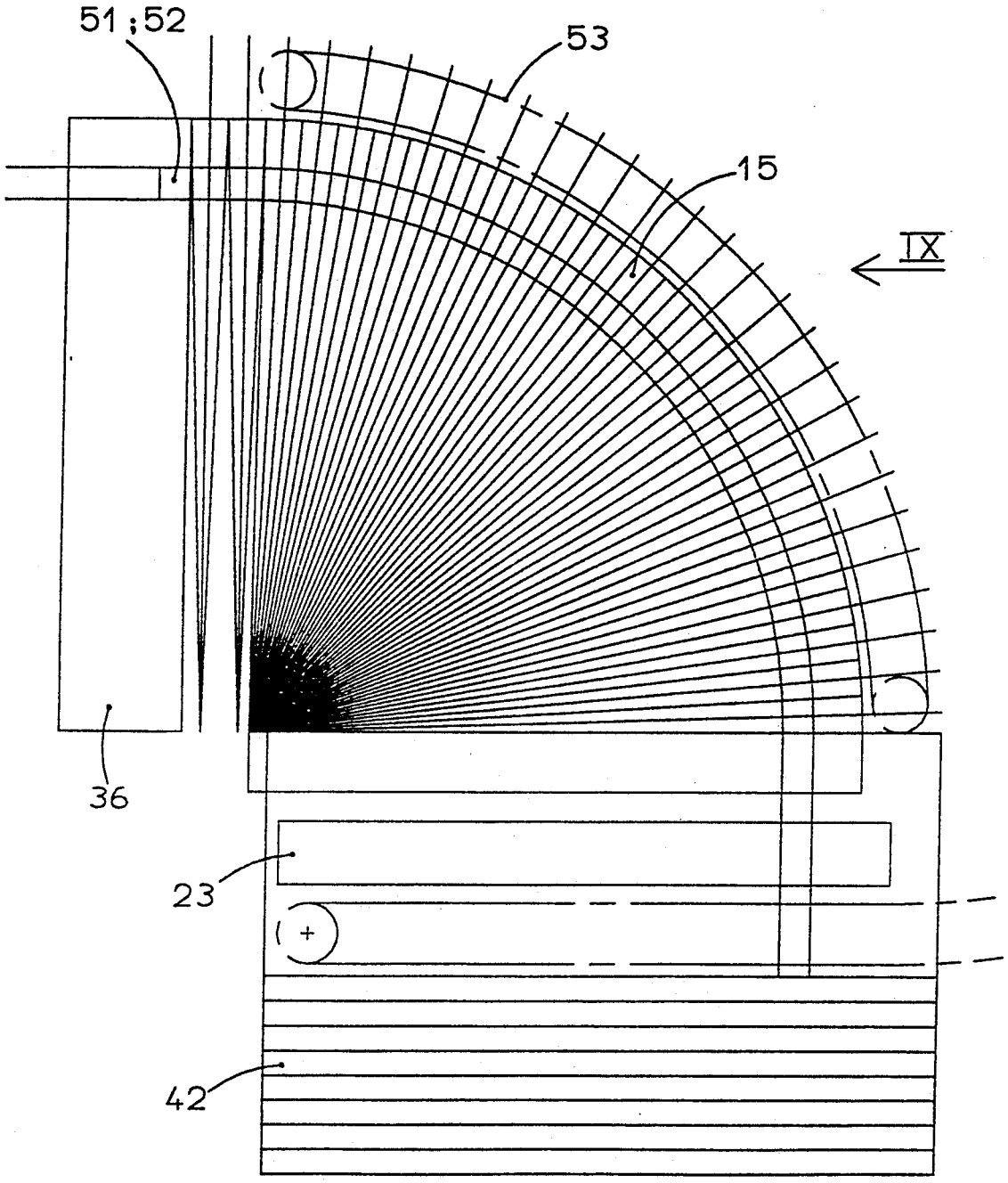
FIG. 8 is a side view of the pocket structure at the end of a stacking process.
Figure 9:
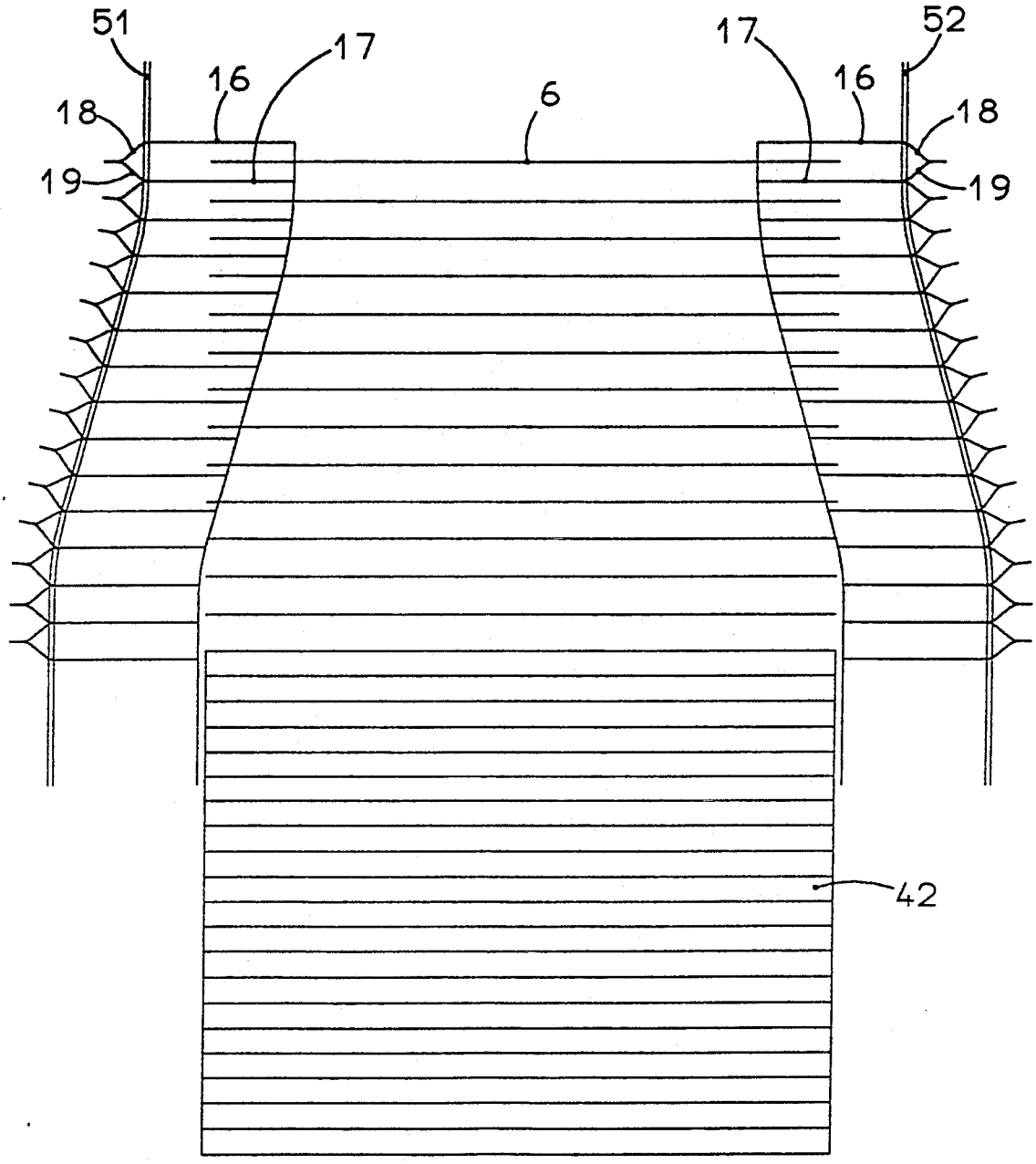
FIG. 9 illustrates the pocket structure of FIG. 8, seen in the direction of the arrow IX.

Another way of removing the signatures from the loaded packages 36 is illustrated in FIGS. 8 and 9. The packages 36 of the pockets can be transported on rails 51, 52 which are not parallel to each other but, rather, deflect outwardly so that the pocket structure halves will spread outwardly and release the signatures from their position in the pocket structures. As the rails 51, 52 diverge, see FIG. 9, for example in the region towards the bottom of the fanned-out pocket structure (see FIG. 8) and the pocket segments 15 are spread apart by the chain drive 53, the signatures will be released to form a stack 42. The spacing of the rails 51, 52 in the region of change-over from retention in the pockets 15 to a loose stack is increased to such an extent that the sheets 6 fall downwardly between the lateral segments 15 and collect as shown in FIG. 8. The empty, separated pocket halves 23 can then be removed laterally from the stack 42 and returned to the overall system for recycling and reuse and collection of subsequent signatures.

Various changes and modifications may be made within the scope of the inventive concept.

Various arrangements can be used to provide for the fan-shaped opening of the pocket structures 15, for example rollers 56 and 57 driven in clocked timing with the drive chains 28, 29 and 43 or 53 in the direction of the arrow 54 or 55 are used to support the bottom of the sheet-metal elements 16, 17 of the pocket structures 15, see FIG. 1, FIG. 2 and FIG. 8. Parallel to the axis, these rollers 56, 57 are circumferentially toothed in order to give a better seat to the sheet-metal elements 16, 17 of the pocket structures 15.

I claim:

1. Removal system for printed products or signatures (6) from a printing machine (1, 2, 3) comprising continuously moving product transport means (5) including gripper means (4) positioned to receive the printed products from the printing machine, a storage unit (26, 33), said storage unit including a plurality of pocket structures (12, 23, 36) positioned to receive the printed products from the transport means (4, 5) at a product loading station (24).

each of said pocket structures comprising a plurality of connected sheet-like elements (16, 17), said sheet-like elements being pivotably coupled together next to each other an end portion and spreadably coupled at a region remote from said end portion to permit, selectively, spreading out, in fan form, of the sheet-like elements and defining pockets or pocket structures (15) between adjacent sheet-like elements for reception of at least one product or signature (6) in the pockets (15) between said elements at said delivery station (24), said sheet-like elements being collapsible towards each other, with or without a product (6) in the pockets (15);

pocket structure transport means (13, 14, 25, 32, 37, 38, 39; 45, 46) engageable with the pocket structure having printed products therein, collapsing the sheet-like elements (16, 17) towards each other to close the pockets or pocket elements (15) and move said pocket structure to said storage unit 926, 33), said pocket structure transport means further being engageable with collapsed, empty pocket structures (23) and moving said empty pocket structures to said delivery position (24) for receiving printed products in the pockets or pocket structures (15) formed by spreading the sheet-like elements (16, 17) of the respective empty pocket structure;

the storage unit (26) storing empty storage structures (23) and receiving storage structures (36) with products or signatures (6) in the pockets thereof, said pocket structure transport means including removal transport means (37, 38, 39, 41, 51, 52) engageable, selectively, with the storage unit (26) for removal of the pocket structure from the storage unit.

2. The system of claim 1, wherein said pocket structure (12) is formed of two pocket parts arranged, essentially, in a single plane to form pocket segment pairs;

said system further including rail means (13, 14; 38, 39; 45, 46; 51, 52), one each retaining a pocket segment pair.

3. The system of claim 1, wherein a predetermined plurality of said pocket structures (12) form a pocket structure package (23).

4. The system of claim 3, wherein the pocket structure transport means includes transport chain means (25); and rail means (13, 14; 38, 39; 45, 46; 51, 52) on which said pocket structure packages are slidable, said transport chain means engaging the pocket structure packages for transport of the pocket structures.

5. The system of claim 1, wherein said storage unit (26) comprises a storage cassette or box.

6. The system of claim 1, wherein said loading station (24) including transport chain means (25) coupled to the storage unit (26) and rail means (13, 14) on which said pocket structures (12) are slidable for, selectively, spreading apart, or collapsing the pocket elements (15) for reception and subsequent transport or storage of signatures.

7. The system of claim 6, wherein said rail means are arranged in essentially part-circular form for spreading the pocket structure in fan configuration.

8. The system of claim 6, including drive chain means (28, 29), and carrier dogs (27) secured to said drive chain means, said drive chain means being located adjacent the rail means (13, 14) and positioned for engagement of the carrier dogs (27) with the segments (15) of the pocket structure for, selectively, spreading the pocket structures apart or collapsing them together.

9. The system of claim 1, wherein the loading station (24) includes suction belt means (10) positioned downstream of the product transport means (5), and a slide surface (11) arranged and positioned to guide signatures transported by said product transport means to a spread-apart pocket (15) of the pocket structure (12), for timed insertion of products or signatures (6) into the pockets.

10. The system of claim 9, further including a cam roller (30) positioned adjacent an end portion of the slide surface (11) close to the pocket structure (12) for lifting the trailing edge of a product or signature (6) at the instant when a subsequent product or signature is ready for insertion into a pocket segment (15).

11. The system of claim 8, wherein the pocket structure transport means includes removal chain means (32) for removing a filled pocket structure (12, 36);

and wherein the operation of said transport chain means (25), said removal chain means (32) and said driven chain means (28, 29) are synchronized to spread, in fan-like configuration, an empty pocket structure (12, 23) during collapsing or closing of a filled pocket structure (12, 36).

12. The system of claim 4, wherein said storage unit includes buffer storage means (33) for temporarily storing said storage unit (26), or a plurality of storage units;

and differential air pressure means (34) located for causing air flow along said pocket segments (15) and hence products or signatures (6) within said pockets or pocket segments.

13. The system of claim 12, wherein said differential air pressure generating means comprises compressed air supply means.

14. The system of claim 1, further including an unloading station (35) positioned for reception of filled pocket structures (12, 36), said unloading station including means for spreading apart said filled pocket structures for removal of products or signatures from the pocket segments (15).

15. The system of claim 14, wherein said unloading station is positioned for cooperation with a printed product or signature transport means to feed said products or signatures back into said printing machine (1, 2, 3) for subsequent printing on said products or signatures.

16. The system of claim 1, further including rail elements (51, 52) retaining end portions of said sheet elements (16, 17), said sheet elements including two essentially coplanar separate parts, said rail elements being spaced from each other by a distance such that the products or signatures fit within the pocket segments (15), and, for removal of products or signatures from the pocket elements, the rail elements include a portion or section in which they diverge by a distance sufficient to permit the products or signatures to fall out from between the parts of the sheet elements.

17. The system of claim 1, wherein the sheet elements comprise elastic sheet-metal parts (16, 17) and elastic, essentially V-shaped connection portions (16, 19) connecting said sheet-metal elements together;

and a projecting means (20) projecting from at least one (16) of the sheet metal elements (16, 17) towards the adjacent sheet-metal element (17) defining the pocket, said projecting means being positioned to engage a marginal, non-printed region of the product or signature, while spacing the sheet-metal elements (16, 17) from each other.

18. The system of claim 17, wherein said projecting means comprises a tab (20) secured to said one sheet-metal element.

19. The system of claim 6, wherein the loading station (24) includes suction belt means (10) positioned downstream of the product transport means (5), and a slide surface (11) arranged and positioned to guide signatures transported by said product transport means to a spread-apart pocket (15) of the pocket structure (12), for timed insertion of products or signatures (6) into the pockets.

20. The system of claim 1, wherein said storage unit includes buffer storage means (33) for temporarily storing said storage unit (26), or a plurality of storage units;

and differential air pressure means (34) located for causing air flow along said pocket segments (15) and hence products or signatures (6) within said pockets or pocket segments.

* * * * *